313-414
9/14/82 XR SR 4,349,767

United States Patent [19]

Muramoto et al.

[11] 4,349,767

[45] Sep. 14, 1982

[54] CATHODE RAY TUBE RESISTANCE OF RUTHENIUM OXIDE AND GLASS CONTAINING ALUMINA POWDER

[75] Inventors: Shoichi Muramoto, Tokyo; Yoshihiro Tsukamura, Kawasaki; Masayuki Tozawa; Fusao Ishii, both of Yokohama, all of Japan

[73] Assignee: Sony Corporation, Tokyo, Japan

[21] Appl. No.: 58,104

[22] Filed: Jul. 16, 1979

Related U.S. Application Data

[63] Continuation-in-part of Ser. No. 868,694, Jan. 11, 1978.

[30] Foreign Application Priority Data

Jan. 17, 1977 [JP] Japan ..... 52-4577
Jul. 15, 1978 [JP] Japan ..... 53-86507

[51] Int. Cl.[3] ..... H01J 29/96; H01J 29/82

[52] U.S. Cl. ..... 313/449; 313/414; 313/417; 338/309; 315/3

[58] Field of Search ..... 313/414, 417, 449, 450, 313/479; 427/126.5

[56] References Cited

U.S. PATENT DOCUMENTS

| | | | |
|---|---|---|---|
| 3,121,181 | 2/1964 | Barneveld et al. | 313/417 X |
| 3,514,663 | 5/1970 | Yoshida et al. | 313/411 |
| 3,677,815 | 7/1972 | Keith et al. | 427/126.5 |
| 3,783,506 | 1/1974 | Rehfeld | 427/126.5 |
| 3,932,786 | 1/1976 | Campbell | 313/414 X |
| 4,052,643 | 10/1977 | Yamazaki et al. | 313/414 X |
| 4,143,298 | 3/1979 | Bing et al. | 313/450 X |
| 4,210,844 | 7/1980 | Buescher et al. | 313/479 |

FOREIGN PATENT DOCUMENTS 47-40987 10/1972 Japan .

*Primary Examiner*—Robert Segal
*Attorney, Agent, or Firm*—Hill, Van Santen, Steadman, Chiara & Simpson

[57] ABSTRACT

An electron gun used in a cathode ray tube, for example, color television picture tube, is disclosed. The electron gun has a plurality of electrodes aligned in one direction along an axis of a neck portion of the cathode ray tube. Each of the electrodes is supplied with a suitable potential for focusing and accelerating an electron beam derived by a cathode. A resistance element which comprises a ceramic substrate coated with a layer of resistive material is provided along and adjacent to the electrodes in the cathode ray tube. One end of the resistance element is electrically connected to the anode potential, and another end is connected to a stem lead pin which is at a substantially low enough potential to avoid mutual electric discharge between stem lead pins. Suitable potential for the selective electrodes is derived from intermediate taps of the resistor and electrode material are composed of a mixture of $RuO_2$ and glass frit. The resistor is overcoated with a glass layer on the surface of the layer of resistive material and the coefficient of thermal expansion of the substrate and glass layer chosen to be similar.

12 Claims, 11 Drawing Figures

CATHODE RAY TUBE RESISTANCE OF RUTHENIUM OXIDE AND GLASS CONTAINING ALUMINA POWDER

CROSS-REFERENCES TO RELATED APPLICATIONS

This application is a continuation-in-part of application Ser. No. 868,694, filed Jan. 11, 1978, entitled "Electron Gun For A Cathode Ray Tube".

BACKGROUND OF THE INVENTION

1. Field of the Invention

The present invention relates to a resistor and electrodes formed on a substrate and which is coated with a glass layer and particular wherein said resistor and electrode is useable in an electron gun of a television set.

2. Description of the Prior Art

In a conventional color television picture tube, a high voltage such as 25~30 KV is applied to the last accelerating electrode of an electron gun unit and a picture screen through an anode button mounted at the funnel portion of a picture tube. At the same time, a voltage of 0~5 KV is applied to a focusing electrode forming a focusing electron lens positioned near the last accelerating electrode, through a terminal pin provided at the end of a neck portion of the picture tube.

In order to make a small beam spot on the picture screen which results in a more precise and clear picture, it is desirable to reduce the aberration of the focuing lens as much as possible. To reduce the aberration of the focusing lens, it is necessary to relax the voltage gradient between the electrodes. To achieve this, there are such methods as widening the distance between the electrodes, applying close voltage to the electrodes, and a combination of the above.

In the case of applying a similar voltage to the electrodes, it is necessary to apply a high voltage of more than 10 KV to the focusing electrode next to the last accelerating electrode. Such high voltage cannot be applied through a terminal pin provided at the end of the neck portion of the picture tube, because there occurs an electric discharge (spark) between the terminal pin and the other terminal pins which supply voltage to other electrodes of the electron gun unit, for example, heaters. Then, it can be supplied through another button provided at the funnel portion, however, it causes complicated assembly and a substantial cost-up.

In the case of a picture tube widely known as a "Trinitron" (registered Trademark of Sony Corporation, the assignee of the present invention), three electron beams are focused by a single electron lens, in which each beam passes through the center of a single electron lens of large diameter. The focused three electron beams are deflected to hit the same position of an apertured grille provided in front of the picture screen by four convergence electrodes provided at the top end of the electron gun unit which makes three passages therebetween for each of the electron beams. Two inner electrodes of the convergence electrode are applied by the same potential as the anode potential. Two outer electrodes of the convergence electrodes are applied by a lower voltage than the anode potential by 0.4~1.5 KV, so that the electron beams which pass through the convergence electrodes are deflected to the side of the center beam.

At one time, the voltages were applied through another button provided at the funnel portion and an electrically shielded cable connected to the button and the outer electrodes.

Now, a co-axial anode button, which has two cylindrical electrodes electrically insulated from each other, is used to provide an anode voltage through an outer electrode of the anode button, and convergence voltage through an inner electrode of the anode button and an electrically shielded cable connecting the inner electrode and the convergence electrodes. By the above co-axial anode button, it is not necessary to provide two buttons at the funnel portion of the picture tube, however, still it is troublesome to connect the inner electrode of the anode button and outer convergence electrodes by the electrically shielded cable.

Other specific disclosures of possible interest are Japanese Publication 40987/72 and U.S. Pat. No. 3,514,663, both assigned to the same assignee as the present invention and U.S. Pat. No. 3,932,786.

SUMMARY OF THE INVENTION

It is an object of the present invention to provide an improved electron gun unit for use in a cathode ray tube.

It is another object of the present invention to provide an electron gun unit in which desired potential to the electrode is applied by a simple construction.

According to an aspect of the present invention, there is provided an improved electron gun which comprises a plurality of electrodes for focusing and accelerating an electron beam arranged along an axis of a neck portion of the cathode ray tube. There is also provided a resistor formed in a zig-zag pattern and electrodes on both ends and intermediate points of the resistor on a ceramic base, which is overcoated with a layer of glass, located within the neck of the picture tube.

One end of the resistor is applied with high voltage which is the same as the anode voltage. Desirable voltages for focusing and/or convergence are obtained from intermediate taps of the resistor, while another end of the resistor is connected to the substantially low voltage.

The resistor is coated with a glass mixture layer to reduce voltage breakdown and the coefficient of thermal expansion of the substrate and glass mixture are chosen to be similar.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

The first embodiment of the invention will be explained with reference to the drawings, in which an electron gun unit with a uni-potential electron lens is applied to a "Trinitron" picture tube.

Figure 1:
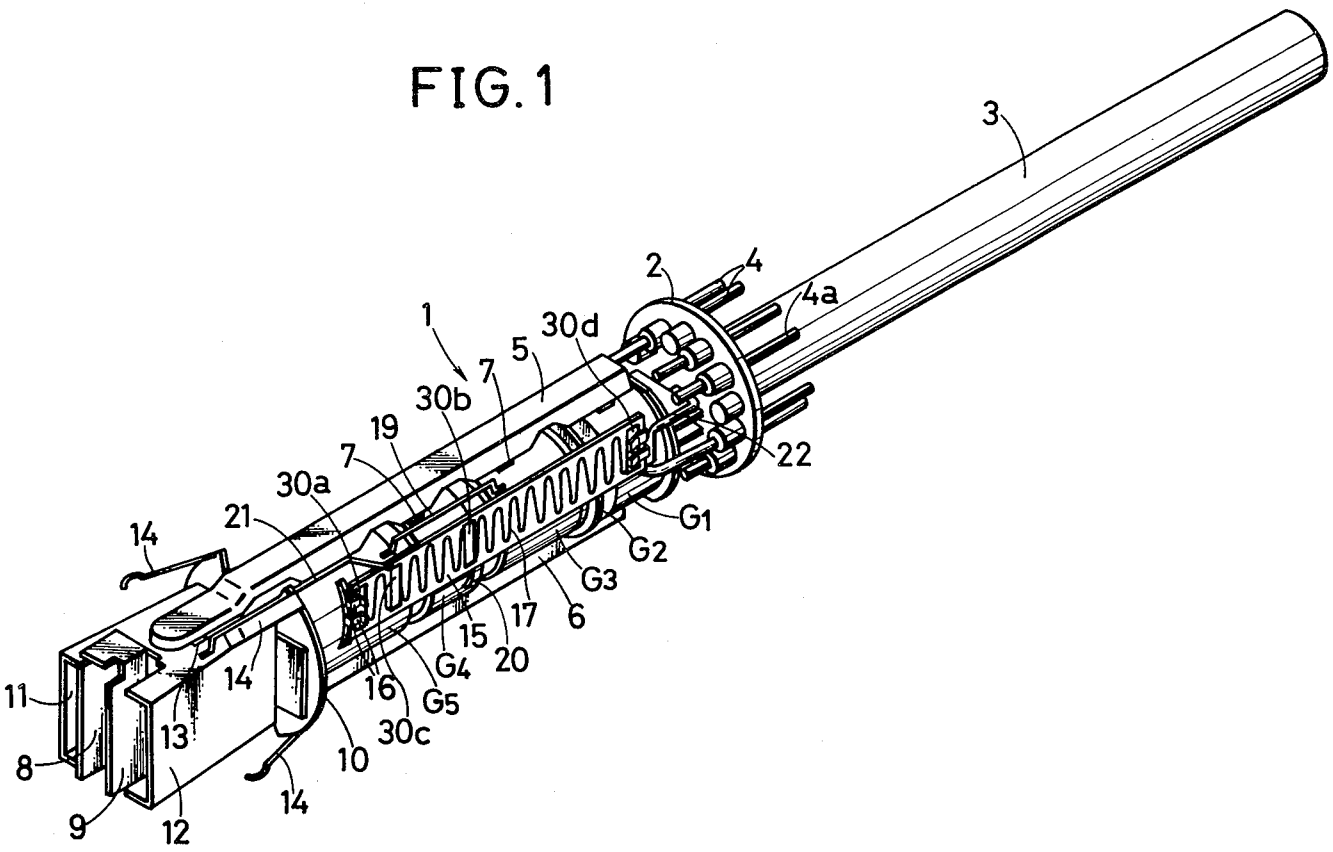
FIG. 1 is a perspective view of an electron gun unit of the present invention.
Figure 2:
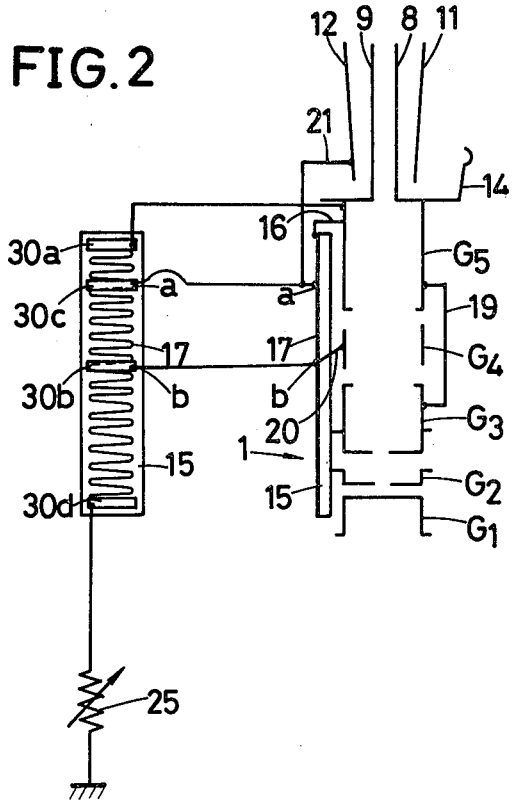
FIG. 2 is a schematic drawing to show the connection between electrodes and the resistor.

As seen in FIGS. 1, 2, an electron gun 1 (see FIG. 1) is mounted in the neck of the tube. The gun 1 includes three cathodes $K_R$, $K_G$ and $K_B$ aligned in a horizontal plane. The three cathodes are positioned behind a control grid $G_1$ which in turn are followed by prefocusing grids $G_2$ and $G_3$. Next in line is the main focusing lens which is formed by grid $G_4$. Grids $G_3$, $G_4$ and $G_5$ are accelerating grids. Thereafter, there is formed the convergence electrodes 8 and 9 and 11 and 12. In passing to screen the electron beam from cathode $K_R$ passes through its associated opening in grid $G_1$ and Grid $G_2$, respectively, then through $G_3$, $G_4$ and $G_5$ and finally between plate electrodes 9 and 12. The electron beam from cathode $K_G$ passes straight through the electron gun 1 and out between convergence plates 8 and 9 before reaching the apertured grille AG. The electron beam from cathode $K_B$ passes through its associated apertures in grid $G_1$ and grid $G_2$, then through $G_3$, $G_4$ and $G_5$, and finally between convergence electrodes 8 and 11 before reaching the apertured grille AG.

A conductive carbon coating is formed over the inner surface of the funnel of the picture tube, and this coating also extends over the inner surface of the neck of the tube back to the area of the convergence electrodes 8, 9, 11 and 12. Terminal pins 4 are formed at the end of the stem 2.

FIG. 1 shows an electron gun unit of the present invention which is sealed in the neck portion of the picture tube, and FIG. 2 shows a connection diagram between the electrodes of the electron gun unit and resistor 15. In FIGS. 1 and 2, a reference number 1 designates an electron gun unit generally. There are provided a stem 2 made of glass, and an evacuation pipe 3 integrally formed with the stem 2 and terminal pins 4 are mounted on the stem 2. The terminal pins are connected to various electrodes, for example, heaters of the cathodes in the picture tube. There are also provided electrodes (grids) $G_1$, $G_2$, $G_3$, $G_4$, $G_5$, arranged coaxially, each having a cylindrical shape and supported integrally by a pair of supporters 5, 6 made of bead glass. Convergence electrodes 8, 9 are attached to a flange portion 10 of the fifth grid $G_5$, and convergence electrodes 11, 12 are supported by the bead glass supporter 5, 6 through a supporting piece 13. A connecting piece 14 is also integrally provided with the flange portion 10. As will be explained, the connecting pieces 14 contact the carbon layer on the inner wall of a funnel portion of the picture tube, through which a desired high voltage $E_b$ which is the same voltage as applied to the picture screen (i.e., the anode voltage), is supplied to the fifth grid $G_5$. There is provided a resistor 15 along the grids $G_1$ $G_5$ supported at one end by a metal supporting piece 16, and at another end by a lead 22. The resistor 15 is formed with a printed resistive path 17 on one surface of a substrate made of an insulating material, for example, a ceramic substrate. The printed resistive path is covered with a glass layer. The size of the resistor is, for example, 10 mm width, 50 mm length, 1.5 mm thickness. An edge of the resistive path 17 and the fifth grid $G_5$ are electrically connected by the supporting piece 16, and the fifth grid $G_5$ and the third grid $G_3$ are electrically connected by a lead 19. A predetermined position b which is spaced a predetermined length from one end of the resistive path 17 and the fourth grid $G_4$ are electrically connected by a lead 20, and another position a which is spaced a predetermined length from one end of the resistive path 17 is electrically connected to the convergence electrodes 11 and 12 by a lead 21. Another end of the resistive path 17 is electrically connected to a terminal pin **4*a* by a lead 22. The convergence electrodes 11 and 12** are electrically connected with each other.

Figure 3:
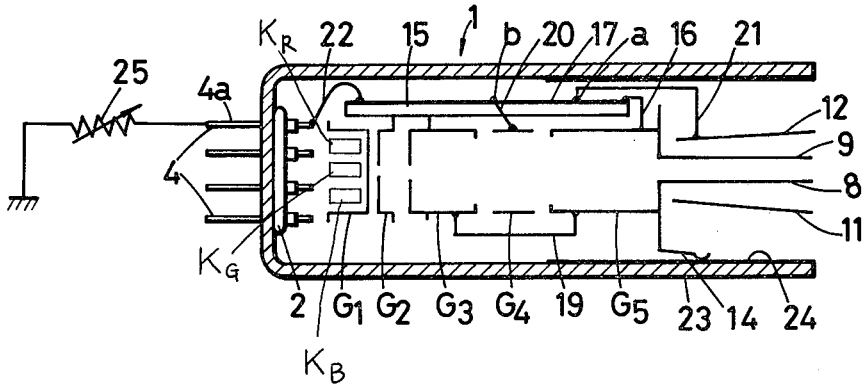
FIG. 3 is a schematic side elevational sectional view to show the electron gun unit of the present invention sealed in a neck portion of the cathode ray tube.

The above constructed electron gun unit is sealed in a neck portion 23 of the picture tube, as shown in FIG. 3. There is provided a carbon coating layer 24 on the inner wall of the neck portion 23 and on the funnel portion (which is not shown in the drawings) of the picture tube, which the connecting pieces 14 engage. The carbon coating layer 24 is electrically connected to a button provided on a funnel portion of the picture tube, through which a high voltage of, for example, 30 KV is applied from the outside of the picture tube. With the above construction, the high voltage applied to the carbon coating layer 24 is applied to the convergence electrodes 8, 9 and the fifth grid $G_5$ through the connecting piece 14, and the same voltage is applied to the third grid $G_3$ through the connecting lead 19 and one end of the resistive path 17 through the supporting piece 16. Thus, the convergence electrodes 8, 9 and the grids $G_3$, $G_5$ are applied with the same potential. The high voltage supplied from the anode button is also applied to the picture screen.

The high voltage applied to the end of the resistive path 17 is divided at the intermediate tap a by the voltage drop caused by the resistive path between the high voltage end and the intermediate tap a, and the derived voltage is applied to the convergence electrodes 11, 12 through the lead 21. It is also divided at the tap b to derive a lower voltage than the anode voltage by the voltage drop between the high voltage end and the tap b, and the derived voltage is applied to the fourth grid $G_4$ through the lead 20. There are provided claws on the leads 21 and 20 which can be attached to the intermediate taps. Thus, the potential applied to the convergence electrodes 11 and 12 is a little lower than the potential applied to the convergence electrodes 8 and 9, for example, 29 KV and the potential of the fourth grid $G_4$ is still lower than that or about 12 KV. The other end of the resistive path 17 is electrically connected to the terminal pin **4*a* mounted in the stem 2 through the lead 22. The terminal pin 4*a* is connected to ground potential through a variable resistor 25. The variable resistor 25 is provided to provide fine control of the potential applied to the convergence electrodes 11 and 12 and the fourth grid $G_4$. The first grid $G_1$ and the second grid $G_2$ are supplied with a predetermined voltage through terminal pins 4 from outside of the picture tube. A current for a heater of the cathode is also supplied through predetermined terminal pins. Thus, each of the electrodes are applied with a desired voltage which is derived from an intermediate tap of the resistor based on the anode voltage obtained by the connecting piece 14**.

In the above example, both the convergence voltage and the focusing voltage are obtained by dividing the anode voltage using the resistor. Of course, it is possible to obtain only the convergence voltage or the focusing voltage. In the case when only the convergence voltage is obtained by dividing the anode voltage, low convergence voltage of 0~5 KV can be supplied through the terminal pin 4.

In the conventional picture tube other than the "Trinitron" (TM) picture tube, only the focusing voltage is obtained by dividing the anode voltage. According to the above-mentioned structure, it is sufficient to provide only one anode button without any special structure, such as a coaxial button. Further, the cable which connects the anode button and the convergence electrodes is not necessary so the assembly is simplified.

As shown in FIG. 1 and FIG. 2, the resistor with a thick layer of resistive material thereon is constructed of an insulating substrate 15; a resistive layer 17 and electrodes 30*a* to 30*d* formed on the substrate.

There are some conditions required for the resistive material so it can be used in resistor 17 assembled into a cathode ray tube. First, the temperature characteristic must not change at high temperatures. Second, it should not vaporize. Third, it should resist a sputtering reaction. Fourth, there should be only small resistance variations.

Especially in the manufacturing process for making a cathode ray tube there is used, for example, a knocking process and it is very undesirable for the resistive material to have a tendency to vaporize at the temperatures of the knocking process. Generally, decrease in vacuum is one of the factors which determines the lifetime of vacuum apparatus such as cathode ray tubes.

Thus, since the vaporizing of material used within a vacuum apparatus is very harmful to such apparatus, the selection of materials and previous treatments must be carefully considered.

After assembly of the electron gun, during the knocking process, high voltage of two times the rated voltage, for example, 50 to 60 KV, is applied between the convergence electrode and terminal pin to cause discharge among the grid electrodes such as $G_1$ to $G_5$, which causes fine scraps of material which occur at the rough cut edges of the cylindrical grid electrodes to be removed. Since the high voltage is also applied to the resistor 17, heat will be produced in the resistor 17 based on $I^2R$, as the product of resistivity R and current I passing therethrough. Accordingly, it is necessary to prevent the resistivity R of the resistor 17 from changing and the resistive material from vaporizing due to the heat produced by Jule's Law.

The resistivity R is selected to be between 300 to 1000 Meg ohm, but the resistance variation should be as small as possible. As shown in FIG. 2, the resistance of the resistive path 17 is $R_1$ between the electrode 30*a* and the point a and is $R_2$ between the point a and the electrode 30*d*. The value of $(R_1/R_1+R_2)$ must stay within +0.3 percent of the predetermined value to stabilize the resistivity.

Another serious problem is the surface discharge produced by the high voltage electric field during the knocking process, which causes a sputtering reaction along the pattern of resistor 17. The resistivity R changes and the sputtered material is harmful to the electron gun due to the sputtering. Therefore, a sputtering reaction should be prevented.

According to this invention, Ruthenium oxide-glass is used for the material of resistor 17. Such a material is made from a mixture of a binder, for example, borosilicate glass, ruthenium oxide powder with additions such as Ti or $Al_2O_3$, an organic binder such as ethylcellulose and solvent such as butyl carbitol acetate to obtain the desired characteristics.

A paste for making the resistor is obtained by stirring up the above materials then the paste is printed in zigzag pattern, as shown in FIG. 1 and 2, on a ceramic substrate 15 having a composition, for example, of 90 to 97% alumina.

The printed substrate is then baked at the temperature range of 750° C. to 850° C. for 40 to 60 minutes, and the coating glass is applied over the resistive path and electrodes. In the paste of ruthenium oxide and glass, as the ratio of $RuO_2$/glass (weight) is increased the surface resistivity decreases. As the grain size of ruthenium oxide increases the surface resistivity increases.

According to this invention, the ratio of $RuO_2$/glass is selected to be about 20/80.

After baking, the thickness of resistor 17 is 10 to 15 μm. Even though the resistor produced is treated under high temperature and high pressure in the knocking process, the variation of resistivity will be less than 10% and almost no vaporization occurs. Moreover, since ruthenium oxide has a small sputtering coefficient, damage to electron gun by sputtering material can be reduced relative to prior art systems.

The electrodes 30*a* to 30*d* can be constructed in the following manner.

Generally, Ag or Ag-Pd is usually used for the electrode material of resistor elements of this type and is formed of a thicker layer. When the resistor element is installed within a vacuum apparatus such as a cathode ray tube, the aforementioned condition 1 to 4 are applicable to the electrodes as well as to resistor 17.

Figure 4:
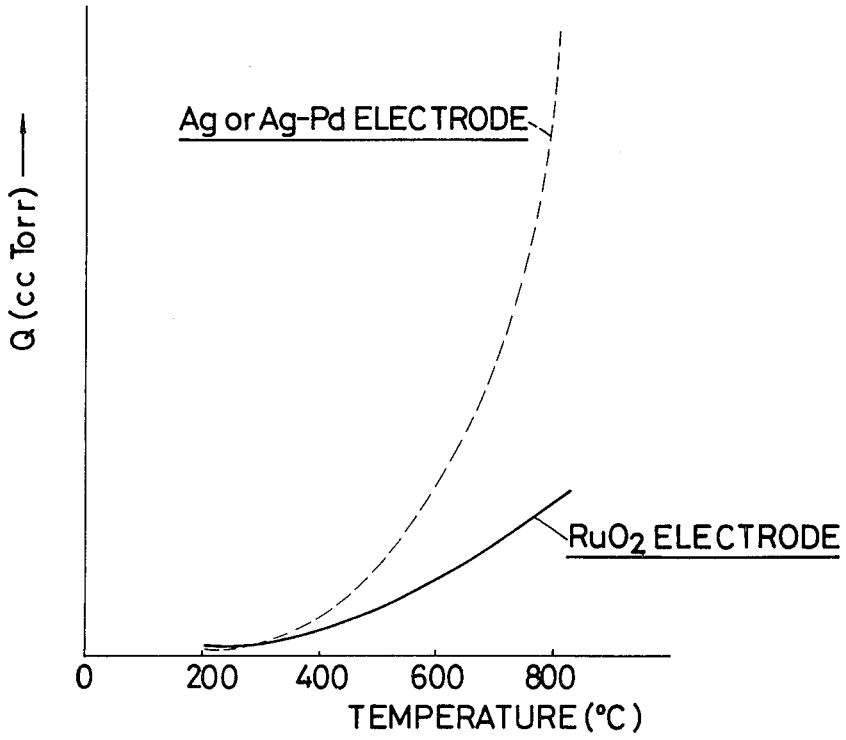
FIG. 4 graphically illustrates the characteristic relation between gas evaporation and temperature of the resistor according to the present invention and the prior art, respectively.

The most serious problem is vaporization from the electrode material and a sputtering reaction to the electrode material under the high temperature and high electric field applied during the knocking process. Experiments during knocking on the resistor element comprising electrodes of Ag or Ag-Pd and with the resistor 17 therebetween and formed with $Ruo_2$-glass formed on the alumina substrate, respectively, as shown in FIG. 4, results in more vaporizing from the electrodes than in the case of electrodes of $RuO_2$ glass and the arc discharge is apt to concentrate on the surface of the electrodes during the knocking process.

According to this invention, the electrodes are formed from the same material as the resistor 17, for example, of $RuO_2$-glass. Also, material with a high ratio of $RuO_2$/glass and a lower sheet resistivity than that used for resistor 17 is suitable for use as the electrodes.

Figure 5A:
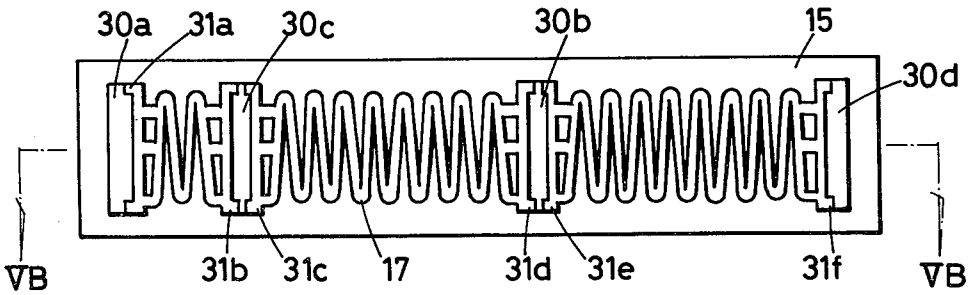
FIGS. 5A, B are plane and side elevational views to show the first embodiment of the resistor of the present invention.

The first embodiment of the resistor according to the present invention is shown in FIGS. 5A, B. The method of manufacturing of the resistor is as follows.

The electrodes 30*a* 30*b*, 30*c* and 30*d* and resistor are formed on the substrate 15 in the pattern shown. After baking, the thickness of electrodes 30*a* to 30*d* is about 10 μm.

The experimental analysis of the resistor element, shown in FIG. 4, shows that the vaporization from the $RuO_2$ electrode was less than that from electrodes of Ag or Ag-Pd. The composition of the gas vaporized from Ag or Ag-Pd electrodes is mostly oxygen. When Ag paste is baked at high temperature, it is subject to be oxidized to produce the mixture of a stable oxide, for example, $Ag_2O$.

First, the electrodes 30*a* to 30*d* are formed in predetermined shapes on the surface of the alumina substrate 15 by coating, as for example, by screen painting. The glass paste with a ratio of $RuO_2$/glass greater than 35/65 is used for the electrodes.

The resistive path 17 is formed in a zig-zag pattern between the electrodes by coating $RuO_2$-glass paste having high sheet resistivity as shown in FIG. 5A. In this case, the guard patterns 31*a* through 31*f* are formed to cover the opposite edges of the electrodes. The resistor element as shown in FIGS. 5A, B is manufactured by baking the alumina substrate with an unstable oxide, for example, AgO or $Ag_2O_2$ and the unstable oxide will be decomposed into $Ag_2O$ and $O_2$ to form a stable oxide. In the resistor element according to the present invention, the guard pattern 31*a* through 31*f* have high resistivity and cover the opposite edges of the electrodes which have low resistivity.

Therefore, during the knocking process, it is difficult for arc discharge to concentrate on the electrodes and sputtering reaction is effectively prohibited.

Figure 6:
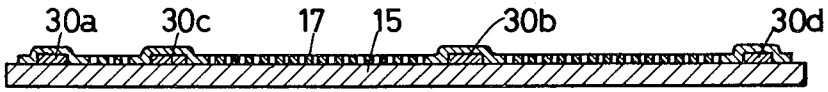
FIG. 6 is a side elevational view to show a second embodiment of the resistor of the present invention.

In the second embodiment shown as FIG. 6, each electrode 30*a* to 30*d* can be completely covered with the resistor 17. In this case, though the contact resistivity increases a small amount, no problem is caused because of the thin layer of the resistor coated over the electrodes.

Figure 7A:
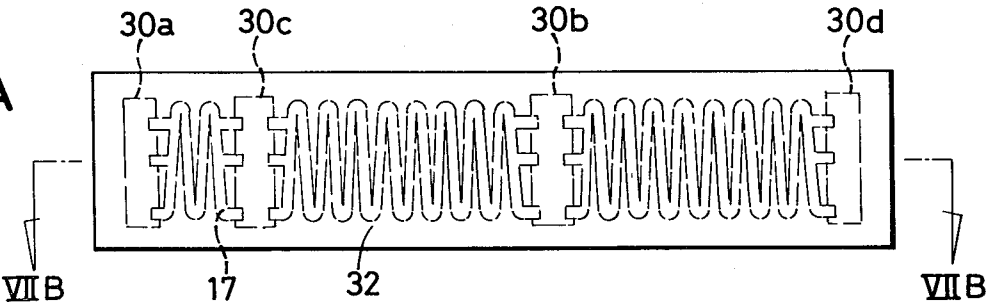
FIGS. 7A and B are plane and side elevational views to show the third embodiment of the resistor of the present invention, respectively.

In the third embodiment shown in FIGS. 7A and B, there is provided a resistor 17 and electrodes 30*a* through 30*d* formed on a substrate 15 with a layer of glass 32 overcoating the whole surface thereof. Such a overcoating layer of glass prevents the electrodes and the resistor from vaporizing at the high temperatures and the resistivity from changing due to sputtering reaction.

A paste containing borosilicate lead glass and 10 to 40 weight % $Al_2O_3$ grained powder is used for a layer of glass 32. The ratio of borosilicate lead glass to alumina (glass/$Al_2O_3$) is selected in ratios, for example, of 90/10, 80/20 and 75/25 and all ratios between these examples.

The mixture of borosilicate lead glass and alumina of the predetermined mixing ratio and 10 to 20 percent organic binder and solvent is coated on the resistor element by screen printing. In this case, in order to make the layer thick, double or triple layers are formed by printing using 50 to 100-mesh screen (200 to 300 μm thickness). A layer of glass 32 having 200 to 400 μm thickness is obtained by baking in the temperature range of 550° to 650° C. for 20 to 30 minutes.

The purpose of mixing $Al_2O_3$ powder into the glass material is to improve the mechanical strength of the glass layer 32. Generally, when the glass layer 32 becomes thick, it is subject to cracks due to incidental forces. However, the mixture of $Al_2O_3$ into the glass material prevents the glass layer from cracking. Moreover, it is possible for the expansion coefficient of the glass layer 32 to match that of the alumina substrate 15.

Figure 8:
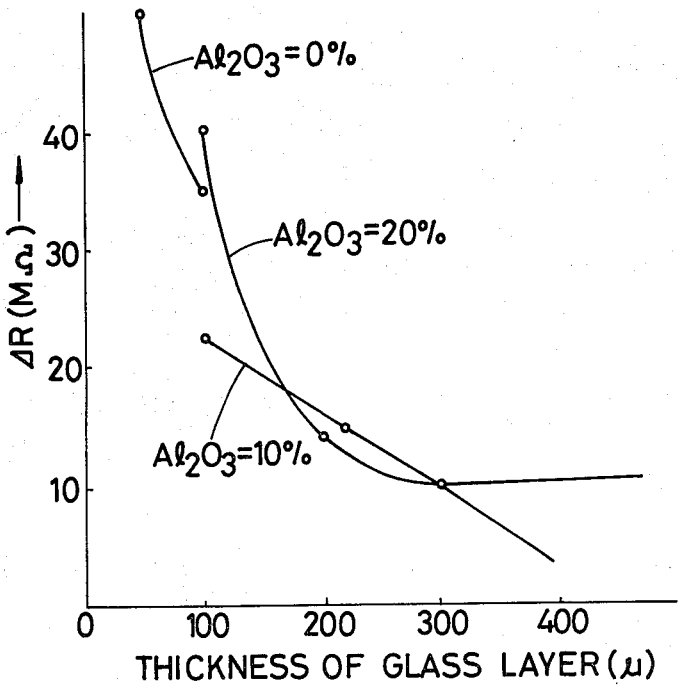
FIG. 8 graphically illustrates the characteristic relation between the thickness of overcoating glass layer and the resistivity variation.

The variation of resistivity of the resistor overcoated by glass containing $Al_2O_3$ after the process of knocking is shown in FIG. 8. The glass paste containing $Al_2O_3$ is used and the mixing ratio of $Al_2O_3$ to glass is varied as shown by the upper curve with 0% $Al_2O_3$, 20% $Al_2O_3$ by the middle curve and 10% $Al_2O_3$ in the lower curve.

The resistor is overcoated by the glass layers and the thickness of the layer is varied as shown.

The electron gun according to the invention is processed by knocking. The variation of resistivity after the knocking process is adjusted with a variable resistor 25 shown in FIG. 2, and the adjusted resistivity of the variable resistor 25 is shown on the ordinate axis of FIG. 8. According to FIG. 8, when the thickness of the glass layer 32 containing 10 to 20 weight % $Al_2O_3$ is selected to be in the range of 200 to 400 μm, the variation of resistivity is very small because the curve is almost flat and is less than the other illustrated examples. On the other hand, if the glass layer doesn't contain any $Al_2O_3$, the thickness of the glass layer cannot be over 80 to 100 μm in thickness because of the mechanical strength and the stability of resistivity. In the case of thicknesses of the glass layer without any $Al_2O_3$ under 80 to 100 μm, the variation of resistivity is so large due to the sputtering process and the high temperature treatment that a glass of that composition cannot be practically used.

Moreover, if the glass layer contains $Al_2O_3$ over 40 weight %, it becomes porous, and therefore it cannot protect the resistor 17 and the electrodes 30*a* through 30*d* from the influence of the sputtering reaction and arc discharge concentration. Although the electrodes 30*a* through 30*d* are not covered with the guard pattern in the embodiment of FIG. 7, they are effectively protected from the sputtering reaction as well as in the case where the glass layer 32 overcoats the resistor shown in FIG. 5 or FIG. 6, and even if the uppermost layer portion of the glass layers 32 is constructed of a glass layer without $Al_2O_3$ with thickness in the range of 50 to 100 μm it can be practically used. Generally, when the glass layer contains $Al_2O_3$ in the mixture, the threshold voltage is slightly decreased. But according to the above-mentioned structure, the variations of resistivity can be reduced and the threshold voltage will be high.

Figure 9:
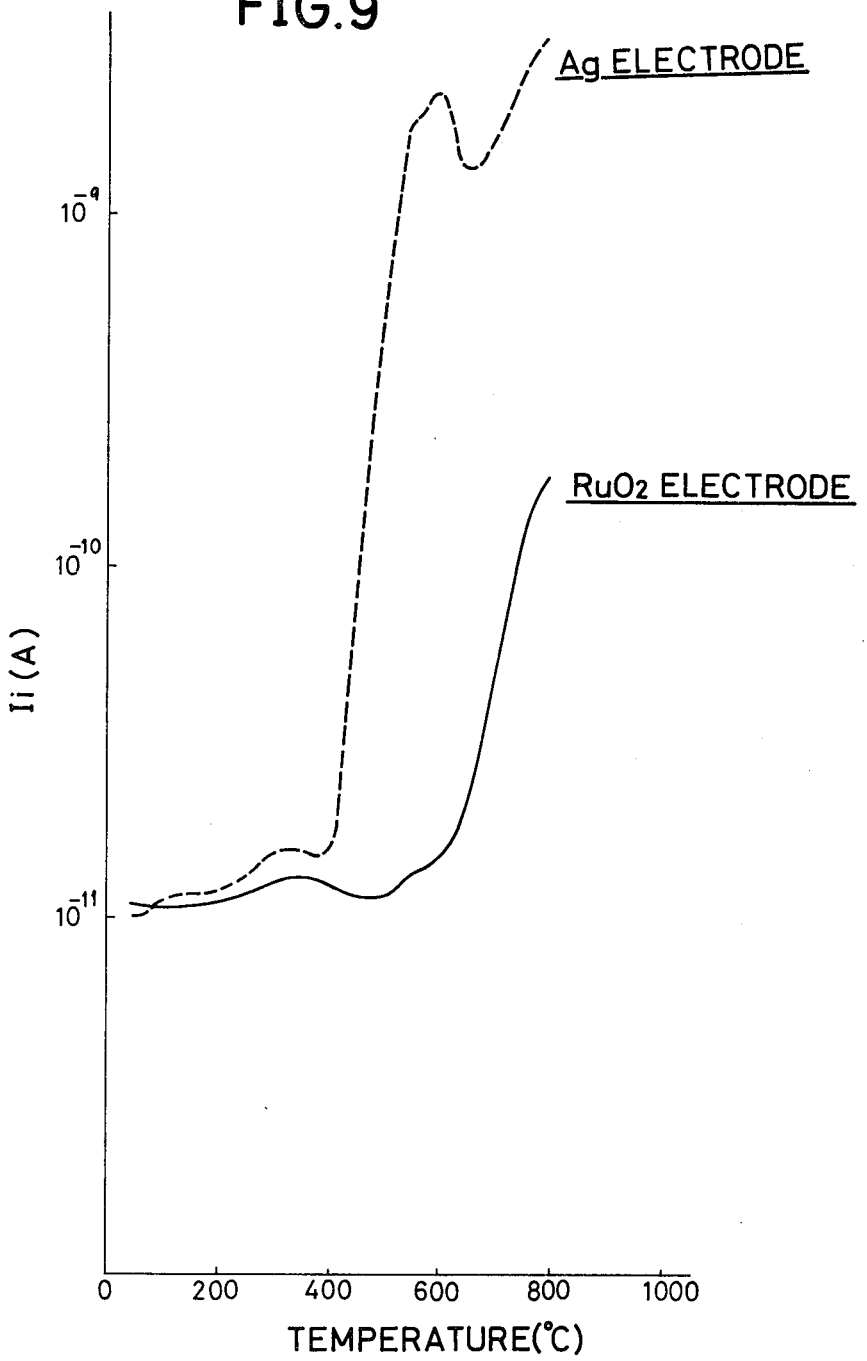
FIG. 9 graphically illustrates the characteristic relation between gas evaporation and temperature of the electrode according to the present invention and the prior art, respectively.

FIG. 9 shows a dashed curved plotted from one resistor with electrodes consisting of Ag and without a glass layer overcoating and the solid line curve is plotted for a resistor with electrodes consisting of $RuO_2$. The graph illustrates the quantity of vaporizing $O_2$ gas from the electrodes material at various temperatures is shown in FIG. 9. The quantity of vaporizing $O_2$ gas is indicated by the ionized current is converted by mass spectrometer analysis of $O_2$ gas vaporizing velocity as shown in the ordinate axis of FIG. 9. According to this invention, the resistor having a thick layer with highly accurate resistivity can be obtained that is stable in electric characteristics under high temperatures and high pressures required in the manufacturing process of cathode ray tubes.

Thus, in the present invention, a glass insulating layer is coated over the entire surface of the resistor which keeps it from sputtering when the electron gun is subjected to the knocking process which utilizes a double voltage that is applied to the high voltage terminal. The knocking process removes burrs due to the discharges.

If a glass insulating overcoating layer was not used, the resistor is likely to be damaged due to arcing between portions of the resistor during the knocking process and the present invention provides protection of the resistor. Also, if resistors are constructed of the conventional material such as silver or silver compounds the resistivity variation will be large after the knocking process. Also, when silver material is used, oxygen gas will be released during the knocking process and when the temperature of the resistive material increases some of the oxygen gas will be evaporated which is injurious to the evacuated apparatus.

Figure 7B:
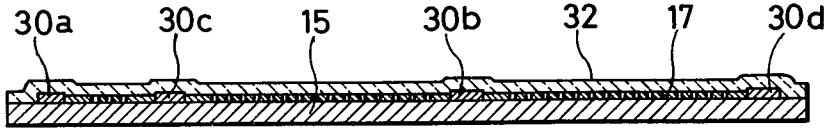

In the present invention, the use of ruthenium oxide does not result in a resistor which evaporates oxygen during the knocking process and the addition of a glass layer over the resistive layer protects the resistor. Such structure is illustrated in FIGS. 7A and 7B, for example. By coating the resistive paths with glass of predetermined thicknesses the resistor is completely protected from damage. Usually, when thick layers of glass are coated, they are apt to be porous and a porous layer is not effective for arc discharge. Also, it is difficult to coat glass thicker than 100 μm. In the present invention, however, the overcoating glass layer is mixed with aluminum powder $Al_2O_3$ so that the mixture makes a coating glass layer which is very strong and which has a substantially increased voltage breakdown characteristic and also the glass is not porous.

The resistor is formed of ruthenium oxide and glass and the terminal at the top has a lower resistivity than the main part of the resistor.

In the present invention, the temperature thermal expansion coefficient of the glass layer is about the same as that of the substrate. The substrate is made of a ceramic such as $Al_2O_3$ and the glass layer contains $Al_2O_3$ powder, binder, solvent and glass so that the ratio of the $Al_2O_3$ to glass is selected so that the temperature coefficient of thermal expansion of the coating in the ceramic substrate will be very similar.

As shown in FIG. 8, if the glass layer contains no $Al_2O_3$ the resistance characteristic change is very high as shown by the top curve. Also, if 100% glass layer with no $Al_2O_3$ is used, it can be easily cracked by being hit accidentally.

By adding $Al_2O_3$ as shown by the curves labeled 10% and 20%, respectively, the resistance to cracking will be improved.

The glass should not contain more than 40% of $Al_2O_3$ because the glass layer will become porous.

When the $Al_2O_3$ is mixed with glass with the $Al_2O_3$, being in the range of 10 to 40% by weight, the mechanical strength and the sputtering characteristics will be good and the thickness of the layer can be in the range of 100 to 400 μm which gives very good characteristics.

Thus, as shown in FIG. 8 in the thickness range between 200–400 μm, the change in resistance is very low after knocking and is less than 10 Mr. The resistivity can be adjusted with the resistor 25, but if the resistivity variation is high it cannot be effectively adjusted.

Figure 5B:
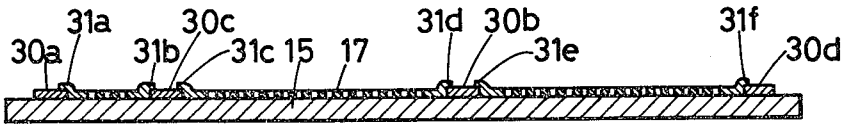

In FIG. 5, the terminal top is covered with resistive pattern and the top is protected from arc discharge by the resistive pattern. One portion must remain uncoated to allow electrical contact to be made to the electrode.

It is seen that this invention provides a new and novel resistor for an electron gun and although it has been described with respect to preferred embodiments, it is not to be so limited as changes and modifications may be made therein which are within the full intended scope as defined by the appended claims.

We claim as our invention:

1. An electron gun which is used for television picture tube having an evacuated bulb including a funnel portion, a neck portion and screen portion including a plurality of electrodes for focusing and accelerating an electron beam generated by a cathode, aligned along the axis of said neck portion, comprising a resistor formed of an insulating substrate on which a resistive path is formed, said substrate being mounted along said plurality of electrodes and sealed in said neck portion, said resistive path having one end tap, another end tap and at least one intermediate tap between said end taps, said one end tap being supplied with the same voltage as the voltage supplied to said screen portion, said another end tap being connected to a terminal pin provided at one end tap of said neck portion for connection to a voltage low enough to avoid an electric discharge between electrodes and said terminal pin, an operating voltage for the electrodes being obtained from said intermediate tap by dividing the voltage between both of said end taps, said resistive path comprising a mixture of ruthenium oxide and glass, and said substrate and said resistive path being overcoated with at least one layer of glass, said layer of glass contained alumina powder.

2. An electron gun according to claim 1, wherein said taps comprise a mixture of ruthenium oxide and glass.

3. An electron gun according to claim 2, wherein the ratio of ruthenium oxide to glass of said taps is higher than that of said resistive path.

4. An electron gun according to claim 2, wherein the sheet resistivity of said taps is lower than that of said resistive path.

5. An electron gun according to claim 1 wherein said layer of glass comprises borosilicate glass and alumina with the ratio of alumina to borosilicate glass being in the range from 5–40 weight percent.

6. An electron gun according to claim 5, wherein the sheet resistivity of said guard patterns is the same as that of said resistive path.

7. An electron gun according to claim 1, including guard patterns of the same material as said resistive path formed on the substrate to cover the opposite edges of said taps.

8. An electron gun according to claim 1, wherein said layer of glass contains 10 to 40 weight % of alumina powder.

9. An electron gun according to claim 1, wherein the thickness of said layer of glass is selected to be in the range from 100 to 400 μm.

10. An electron gun according to claim 1, wherein the uppermost layer of said layer of glass is formed of a glass layer which does not contain alumina powder.

11. An electron gun according to claim 1, wherein the thermal expansion coefficient of said glass layer is substantially the same as that of said insulating substrate.

12. An electron gun according to claim 1, wherein said insulating substrate is alumina.

* * * * *